US008152624B2

(12) United States Patent
Gerrard et al.

(10) Patent No.: US 8,152,624 B2
(45) Date of Patent: Apr. 10, 2012

(54) GAMING DEVICE AND METHOD PROVIDING A PLURALITY OF PLAYS OF A BACKGROUND GAME RESULTING IN A SINGLE AWARD FOR THE PLAYER

(75) Inventors: Peter Gerrard, Prestwich (GB); Bryan D. Wolf, Reno, NV (US)

(73) Assignee: IGT, Reno, NV (US)

( * ) Notice: Subject to any disclaimer, the term of this patent is extended or adjusted under 35 U.S.C. 154(b) by 838 days.

(21) Appl. No.: 11/853,952

(22) Filed: Sep. 12, 2007

(65) Prior Publication Data

US 2009/0069073 A1 Mar. 12, 2009

(51) Int. Cl.
*A63F 9/24* (2006.01)

(52) U.S. Cl. ..... 463/20; 463/16; 463/25

(58) Field of Classification Search ..... 463/16, 463/20, 25

See application file for complete search history.

(56) References Cited

U.S. PATENT DOCUMENTS

| | | | |
|---|---|---|---|
| 4,332,389 | A | 6/1982 | Loyd, Jr. et al. |
| 4,365,810 | A | 12/1982 | Richardson |
| 4,373,726 | A | 2/1983 | Churchill et al. |
| 4,455,025 | A | 6/1984 | Itkis |
| 4,582,324 | A | 4/1986 | Koza et al. |
| 4,624,462 | A | 11/1986 | Itkis |
| 4,798,387 | A | 1/1989 | Richardson |
| 4,848,771 | A | 7/1989 | Richardson |
| 4,856,787 | A | 8/1989 | Itkis |
| 5,007,649 | A | 4/1991 | Richardson |
| 5,042,809 | A | 8/1991 | Richardson |
| 5,242,163 | A | 9/1993 | Fulton |
| 5,297,802 | A | 3/1994 | Pocock et al. |
| 5,324,035 | A | 6/1994 | Morris et al. |
| 5,351,970 | A | 10/1994 | Fioretti |
| 5,393,057 | A | 2/1995 | Marnell, II |
| 5,489,101 | A | 2/1996 | Moody |
| 5,531,448 | A | 7/1996 | Moody |
| 5,639,088 | A | 6/1997 | Schneider et al. |
| 5,732,950 | A | 3/1998 | Moody |
| 5,816,916 | A | 10/1998 | Moody |
| 5,823,873 | A | 10/1998 | Moody |
| 5,833,540 | A | 11/1998 | Miodunski et al. |
| 5,908,354 | A | 6/1999 | Okuniewicz |

(Continued)

FOREIGN PATENT DOCUMENTS

| | | |
|---|---|---|
| WO | WO 99/10849 | 3/1999 |

(Continued)

OTHER PUBLICATIONS

Austin Powers Groooovy, Baby Article, written by Strictly Slots, published in Apr. 2002.

(Continued)

*Primary Examiner* — Omkar Deodhar
(74) *Attorney, Agent, or Firm* — K&L Gates LLP

(57) ABSTRACT

A gaming device, system and method which enables a player to apply a large wager amount to a plurality of plays of a background game in increments or portions. The gaming device apportions or applies the large wager amount to a plurality of plays of a background game. The gaming device displays a play of the primary game to the player that provides a primary game outcome which has an award equal to the amount of the sum of the background game results.

24 Claims, 16 Drawing Sheets

U.S. PATENT DOCUMENTS

| | | | |
|---|---|---|---|
| 5,949,042 | A | 9/1999 | Dietz, II et al. |
| 5,954,335 | A | 9/1999 | Moody |
| 5,976,016 | A | 11/1999 | Moody et al. |
| 5,980,384 | A | 11/1999 | Barrie |
| 6,007,066 | A | 12/1999 | Moody |
| 6,012,983 | A | 1/2000 | Walker et al. |
| 6,012,984 | A | 1/2000 | Roseman |
| 6,024,640 | A | 2/2000 | Walker et al. |
| 6,077,163 | A | 6/2000 | Walker et al. |
| 6,093,100 | A | 7/2000 | Singer et al. |
| 6,098,985 | A | 8/2000 | Moody |
| 6,120,378 | A | 9/2000 | Moody et al. |
| 6,146,276 | A | 11/2000 | Okuniewicz |
| 6,149,156 | A | 11/2000 | Feola |
| 6,168,521 | B1 | 1/2001 | Luciano |
| 6,183,361 | B1 | 2/2001 | Cummings et al. |
| 6,244,957 | B1 | 6/2001 | Walker et al. |
| 6,280,325 | B1 | 8/2001 | Fisk |
| 6,311,978 | B1 | 11/2001 | Moody |
| 6,315,291 | B1 | 11/2001 | Moody |
| 6,319,127 | B1 | 11/2001 | Walker et al. |
| 6,364,313 | B1 | 4/2002 | Moody |
| 6,368,212 | B1 | 4/2002 | Moody |
| 6,419,578 | B1 | 7/2002 | Moody et al. |
| 6,419,583 | B1 | 7/2002 | Crumby et al. |
| 6,471,591 | B1 | 10/2002 | Crumby |
| 6,475,085 | B2 | 11/2002 | Moody |
| 6,478,677 | B1 | 11/2002 | Moody |
| 6,517,074 | B1 | 2/2003 | Moody et al. |
| 6,524,185 | B2 | 2/2003 | Lind |
| 6,533,279 | B2 | 3/2003 | Moody et al. |
| 6,533,664 | B1 | 3/2003 | Crumby |
| 6,537,150 | B1 | 3/2003 | Luciano et al. |
| 6,561,898 | B2 | 5/2003 | Moody |
| 6,568,680 | B1 | 5/2003 | Moody et al. |
| 6,569,017 | B2 | 5/2003 | Enzminger et al. |
| 6,585,592 | B1 | 7/2003 | Crumby |
| 6,599,192 | B1 | 7/2003 | Baerlocher et al. |
| 6,634,942 | B2 | 10/2003 | Walker et al. |
| 6,638,163 | B2 | 10/2003 | Moody |
| 6,638,170 | B1 | 10/2003 | Crumby |
| 6,645,075 | B1 | 11/2003 | Gatto et al. |
| 6,648,756 | B2 | 11/2003 | Moody |
| 6,652,377 | B1 | 11/2003 | Moody |
| 6,656,040 | B1 | 12/2003 | Brosnan et al. |
| 6,656,044 | B1 | 12/2003 | Lewis |
| 6,672,959 | B2 | 1/2004 | Moody et al. |
| 6,729,621 | B2 | 5/2004 | Moody |
| 6,758,750 | B2 | 7/2004 | Baerlocher et al. |
| 6,790,143 | B2 | 9/2004 | Crumby |
| 6,802,773 | B2 | 10/2004 | Moody |
| 6,802,776 | B2 | 10/2004 | Lind et al. |
| 6,840,858 | B2 | 1/2005 | Adams |
| 6,840,860 | B1 | 1/2005 | Okuniewicz |
| 6,852,030 | B2 | 2/2005 | Baerlocher et al. |
| 6,875,110 | B1 | 4/2005 | Crumby |
| 6,877,747 | B2 | 4/2005 | Moody |
| 6,878,060 | B2 | 4/2005 | Moody |
| 6,939,224 | B2 | 9/2005 | Palmer et al. |
| 6,955,356 | B2 | 10/2005 | Moody |
| 6,964,418 | B2 | 11/2005 | Moody |
| 6,969,317 | B2 | 11/2005 | Walker et al. |
| 7,037,190 | B2 | 5/2006 | Moody et al. |
| 7,131,500 | B2 | 11/2006 | Jomphe |
| 7,137,628 | B2 | 11/2006 | Moody |
| 7,140,964 | B2 | 11/2006 | Walker et al. |
| 7,156,397 | B2 | 1/2007 | Moody et al. |
| 7,222,857 | B2 | 5/2007 | Moody |
| 7,222,858 | B2 | 5/2007 | Moody |
| 7,241,221 | B1 | 7/2007 | Luciano, Jr. et al. |
| 7,247,091 | B2 | 7/2007 | Moody |
| 7,252,590 | B2 | 8/2007 | Palmer et al. |
| 7,316,608 | B2 | 1/2008 | Moody |
| 2002/0113369 | A1 | 8/2002 | Weingardt |
| 2002/0132660 | A1 | 9/2002 | Taylor |
| 2002/0132661 | A1 | 9/2002 | Lind et al. |
| 2003/0119586 | A1 | 6/2003 | Crumby |
| 2003/0125101 | A1 | 7/2003 | Campo |
| 2003/0130029 | A1 | 7/2003 | Crumby |
| 2004/0063489 | A1 | 4/2004 | Crumby |
| 2004/0102238 | A1 | 5/2004 | Taylor |
| 2004/0147308 | A1 | 7/2004 | Walker et al. |
| 2005/0085294 | A1 | 4/2005 | Walker et al. |
| 2005/0085295 | A1 | 4/2005 | Walker et al. |
| 2005/0130729 | A1 | 6/2005 | Baerlocher et al. |
| 2005/0148393 | A1 | 7/2005 | Crumby |
| 2005/0164779 | A1 | 7/2005 | Okuniewicz |
| 2005/0181854 | A1 | 8/2005 | Moshal |
| 2005/0233798 | A1 | 10/2005 | Van Asdale |
| 2005/0239527 | A1 | 10/2005 | Moody |
| 2005/0239528 | A1 | 10/2005 | Moody |
| 2005/0250578 | A1 | 11/2005 | Slomiany et al. |
| 2006/0025209 | A1 | 2/2006 | Walker et al. |
| 2006/0046835 | A1* | 3/2006 | Walker et al. ..... 463/20 |
| 2006/0142079 | A1 | 6/2006 | Ikehara et al. |
| 2006/0146773 | A1 | 7/2006 | An et al. |
| 2006/0166725 | A1* | 7/2006 | Saffari et al. ..... 463/2 |
| 2006/0172794 | A1 | 8/2006 | Walker et al. |
| 2007/0155471 | A1 | 7/2007 | Powell et al. |
| 2007/0155472 | A1 | 7/2007 | Gail et al. |
| 2007/0155473 | A1 | 7/2007 | Powell et al. |
| 2007/0161423 | A1 | 7/2007 | Bienvenue et al. |
| 2007/0270204 | A1 | 11/2007 | Palmer et al. |
| 2009/0061996 | A1 | 3/2009 | Walker et al. |

FOREIGN PATENT DOCUMENTS

| | | |
|---|---|---|
| WO | WO 02/099760 | 12/2002 |

OTHER PUBLICATIONS

Austin Powers Poker and Flex Play Poker Advertisement, written by IGT, published in 2001.

Double Down Stud Poker—Triple Play/Five Play/Ten Play Advertisement, written by IGT, published in 2004.

Draw Poker (Five Play, Triple Play and Ten Play) Advertisement, written by IGT, published in 2003.

Fifty Play Poker Advertisement, written by IGT, published in 2001.

Fifty Play Poker Article [online] [retrieved on Mar. 21, 2001]. Retrieved from the Internet at <URL: http://www.igt.com>.

Flex Play Poker Advertisement, written by IGT, published in 2001.

Game King Series Ten Play Draw Poker Advertisement, written by IGT, published in 2001.

Game King Series Triple Play—Five Play Draw Poker Advertisement, written by IGT, published in 2001.

Triple Play/Five Play/Ten Play Draw Poker Advertisement, written by IGT, published prior to Sep. 12, 2007.

* cited by examiner

FIG. 4A

| Game | Game Result |
|---|---|
| 1 | 0 |
| 2 | 0 |
| 3 | 0 |
| 4 | 40 |
| 5 | 0 |
| 6 | 0 |
| 7 | 30 |
| 8 | 0 |
| 9 | 0 |
| 10 | 20 |
| 11 | 0 |
| 12 | 0 |
| 13 | 0 |
| 14 | 0 |
| 15 | 38 |
| 16 | 0 |
| 17 | 0 |
| 18 | 0 |
| 19 | 0 |
| 20 | 0 |
| 21 | 20 |
| 22 | 0 |
| 23 | 0 |
| 24 | 0 |
| 25 | 32 |
| TOTAL | 180 Credits |

110

FIG. 6D

| Background Game | Background Game Result |
|---|---|
| 1 | 0 |
| 2 | 0 |
| 3 | 2 |
| 4 | 4 |
| 5 | 0 |
| 6 | 0 |
| 7 | 6 |
| 8 | 0 |
| 9 | 0 |
| 10 | 2 |
| 11 | 1 |
| 12 | 2 |
| 13 | 0 |
| 14 | 0 |
| 15 | 1 |
| Total | 18 Credits |

GAMING DEVICE AND METHOD PROVIDING A PLURALITY OF PLAYS OF A BACKGROUND GAME RESULTING IN A SINGLE AWARD FOR THE PLAYER

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Primary wagering games of gaming machines in most jurisdictions are games of luck. For instance, in slot machines, the player must make a wager on the slot game to begin the slot game, and the gaming machine randomly determines the outcome for the slot game. The outcome may be a winning outcome or a losing outcome. The outcome determines whether the player obtains an award according to the paytable of the slot machine.

Most slot machines are set to pay back on average between 80 and 99 percent of the amounts that the players wager. Generally, a single play of a primary game is a volatile and isolated event. Each single play of the primary game thus does not provide the player a consistent chance of winning an outcome that is in line with the average expected payback percentage for the gaming device. In any single play of a primary game, the player may: (a) lose their entire wager amount on that play of the primary game; (b) lose a portion of their entire wager amount on that play of the primary game; (c) win back an amount exactly equal to their entire wager amount on that play of the primary game; or (d) win an amount greater than their entire wager amount on that play of the primary game.

Since players run the risk of losing all or a significant portion of their wager on a single play of the primary game, some players are inclined not to wager large amounts on a single play of a primary game of a slot gaming machine or other similar machine. For instance, most players are not inclined to wager $100 on a single play of a game because, while they can win a significant amount, they can lose all or a significant portion of the $100 in a single play in a very short time period. However, a greater number of players are comfortable with a $100 gambling session if it is extended over a relatively large number of plays, such as one hundred consecutive plays. Although some players enjoy this extremely high level of volatility, the volatility associated with a single play of a primary game can be too much for other players.

Accordingly, there is a continuing need to provide gaming devices that limit or diversify the risk associated with placing large wagers in a single game.

SUMMARY

In one embodiment, the present disclosure provides a gaming device, system and method which enables a player to place a large wager on a single play of a primary game with a much lower volatility. The gaming device apportions or applies the large wager amount to a plurality of plays of a background game. The gaming device determines a result for each play of the background game. In one embodiment, the background game result is either a positive number of credits or zero credits. The gaming device displays a play of the primary game to the player that provides a primary game outcome which has an award equal to the amount of the sum of the background game results. By applying a large wager in smaller portions to a number of plays of the background game, the gaming device enables that player to have a better chance of receiving an award closer to an average expected payout. That is, the plays of the background game determine the outcome and award of the primary game substantially reducing the volatility of a single play of the primary game. In one embodiment, the gaming device does not display and does not otherwise inform the player of the plays of the background games or the results of the background games. That is, in one embodiment, the gaming device only informs the player of the primary game and the player is not aware of the existence of the background game.

In one embodiment, the gaming device includes a primary game and a background game. The gaming device enables a player to make a wager. Upon receiving the wager, the gaming device determines a portion of the wager that will be automatically wagered on each play of the background game. The gaming device determines the number of plays of the background game. The gaming device causes this number of plays of the background game by quickly and randomly generating a background game result for each play of the background game without displaying the plays of the background game. The gaming device determines a combined background game result from the plurality of plays of the background game that will be provided to the player as an award in the primary game. For example, the gaming device sums the result of each play of the background game which will be provided to the player as a single primary game award after an outcome of a single play of the primary game is displayed to the player. After determining the overall or combined result for the plays of the background game, the gaming device determines a game outcome from a primary game paytable with an award that equals the sum of the background game results. The gaming device displays a play of the primary game to the player, wherein the play of the primary game provides the primary game outcome (such as a symbol combination) which has an award equal to the amount of the sum of the results from the plays of the background games. The gaming device provides the player this award which is the previously determined combined background game results. In one embodiment, the gaming device simultaneously or substantially simultaneously determines or calculates the background game results and displays a play of the primary game. For example, the gaming device displays the reels spinning in a slot game while simultaneously calculating the background game results.

The portions, components or increments wagered per play of the background game may be any suitable portions. For example, a player makes a wager of $100 on a single play of the primary game. The gaming device applies the player's wager to 100 plays of a background game in increments of $1 for each play of the background game. The gaming device executes the 100 plays of the background game (without displaying such plays to the player) and determines 100 background game results. The gaming device combines the background game results and determines a single primary game award for the player based on the combined background game results. The gaming device displays a play of the primary game to the player, wherein the outcome of the play of the primary game is associated with an award equal to the combined background game result. Therefore, the gaming device displays one award to the player which represents the outcome of the 100 plays of the background game at $1 per play.

Distributing a wager amount over a plurality of plays of a game decreases the risk of a player losing a relatively high entire wager amount and decreases the volatility of the awards. In the above example, applying the wager in small portions to a plurality of plays of the background game rather than applying the entire wager to a single play, gives the player a more balanced chance of receiving an award than the player would have in a play of a single game. There is also a greater chance that the result for the 100 plays at $1 per play will be closer to the average expected payout than just one single play in which the player wagers the entire $100. Except for an even win, if the player won on a single play of the game with a $100 wager, the player would win well over the average expected payout for that gaming device. If the player did not win on a single play of the game with a $100 wager, the player would win well under the average expected payout for that gaming device. As the wager portions decrease and the number of plays of the background increase, the background game results get closer to the average expected payout of the gaming device. For example, a wager of $100 on 1000 plays of the background game with a $0.10 wager portion is closer to the average expected payout than a $100 wager divided over 100 games. Likewise, a wager of $100 on 10,000 plays of the background game with a $0.01 wager portion is closer to the average expected payout than a $100 wager divided over 100 games or even 1000 games. However, as the wager portions decrease the probability or the possibility of achieving a large award decreases. Therefore, in certain embodiments, the gaming device determines a range of the wager portion amounts and a range of the number of plays of the background game that decrease the volatility such that a player is likely to win an award but does not decrease the volatility so dramatically to eliminate the possibility of receiving a larger award. The ranges of wager portions and number of plays of the background game can vary from game to game. These ranges may be influenced by the volatility of the primary game. Wagering the award in smaller increments decreases the volatility of the game and increases the likelihood that the player will win an award.

It should be appreciated that the volatility may be determined in any suitable manner. The number of plays of the background game and the amount wagered on each background game determines the volatility. For example, a wager of $50 applied to 5 games has a much higher volatility than a wager of $50 applied to 50 games. It should be appreciated that the wager portions, components or increments may be determined in any suitable manner. In one embodiment, the gaming device determines the amount of the wager portions. In one embodiment, the gaming device then determines how many background games to play based on the amount wagered. In another embodiment, the gaming device determines the number of plays of the background game and then determines the amount of the wager portions. In one embodiment, the wager portions are different amounts. In another embodiment, the wager portions are the same amount. In certain embodiments, the gaming device does not display any information about the background game to the player. Rather, the gaming machine advertises the lower volatility to the player but does not display the background games or inform the player about the occurrence of the background games.

In an alternative embodiment, the gaming device enables the player to choose how the wager is applied to the plays of the background game. For example, the gaming device enables the player to select between a lower or higher volatility. In one embodiment, the gaming device enables a player to determine the actual amount of the wager portions. In one such embodiment, the gaming device includes a set up menu which enables the player to choose the wager portions and/or how many background games to play with the wager. In one embodiment, the gaming device enables the player to determine how many background games to play, and the gaming device determines how much of the wager will be applied to each game. The player may select more of less games to determine the volatility. For example, if the player selects to wager $10 and selects to play ten background games, the wager portion for each background game is $1 a game. If the player selects to wager $10 and selects to play twenty background games, the wager portion for each background game is $0.50 a game, a lower volatility than the $1 a game.

The primary game and the background game may be any suitable game including but not limited to slot, bingo, poker, keno, blackjack, craps, bunco, checkers and any combination thereof. The primary game and the background game may be the same game or different games. The background games may be different in any suitable way. In one embodiment, one or more background games is the same type of game and has different paytables, volatilities, different probabilities of winning an award or achieving a game outcome, different winning game outcomes, different progressive eligibility, or any suitable other features. Likewise, in one embodiment, one or more background games are different types of games and has different paytables, volatilities, different probabilities of winning an award or achieving a game outcome, different winning game outcomes, different progressive eligibility, or any suitable other features. In one embodiment, a single primary game includes a plurality of different types of background games. It should be appreciated that in different embodiments a background game result may be generated any suitable number of times. For example, if the available background results are inclusively the numbers one to ten, two may be generated twenty times in a row or may be generated once and then three is generated two times in a row. In one embodiment, the background game is simply a generation of results and does not generate a game outcome for each game. For example, the gaming device randomly generates a background result of zero credits for a first background game and a result of ten credits for a second background game. In one embodiment, the background game results are not associated with background game outcomes but are only associated with results. For example, the gaming device does not generate the symbol combination of 7-bar-7-diamond-7 which results in an award of zero credits and bar-bar-bar-7-diamond which results in an award of ten credits. The gaming device randomly generates a background game result of zero and a background game result of ten. In another embodiment, the gaming device generates background game outcomes and associates the background game outcomes with background game results. For example, the gaming device generates the symbol combination of 7-bar-7-diamond-7 which results in an award of zero credits and generates bar-bar-bar-7-diamond which results in an award of ten credits for the background game.

In another embodiment, the background game is a slot game and the gaming device continually and randomly generates random numbers or seeds. In one embodiment, each of the seeds is associated with a symbol. When the player selects to play the primary game, the gaming device selects or generates a next amount of calculated seeds based on the number of seeds required to determine outcomes of the background game. For example, if the game is a three reel slot game, for each play of the background game, the gaming device selects the next three seeds and determines which symbol is associated with each selected seed. The gaming device then evaluates each symbol combination to determine the associated background game result. The gaming device repeats this process for each play of the background game. If the gaming device determines to play 100 plays of the three-reel slot background game, upon a player initiating the primary game, the gaming device selects the next 300 randomly generated seeds. The gaming device determines an outcome for a play of the game every three seeds and evaluates this background game outcome to determine the associated background game result. The gaming device accumulates all of the background game results and provides a primary game award equal to the sum of the background game results. It should be appreciated that the selection or calculation of seeds and generating a game outcome rapidly generates a plurality of randomly determines background game results.

In another embodiment, one or more background game results can be determined by different determinations in a same game. In one embodiment, the background game is a slot game with a plurality of different paylines. Each payline determination provides a background game result. For example, a primary game is a single payline slot game and the background game includes fifty paylines. In one embodiment, the maximum number of background games for a single play of a primary slot game is fifty. Upon a player input or a determination by the gaming device, the gaming device determines a certain number of background game results to evaluate. The gaming device generates a plurality of symbols and separately evaluates each of the determined paylines to determine a background game result. The gaming device sums each of the background game results and provides the player with one or more primary game outcomes and one or more primary game awards based on the summed background game results.

The gaming system may determine the background game results in any suitable manner. In one embodiment, the gaming system determines the background game results through central determination methods. In another embodiment, the gaming system determines the background game results from an on-going bingo game. In another embodiment, the background game is a multi-hand poker game utilizing any suitable number or quantity of hands, such as a multiple play poker.

Accordingly, the present disclosure provides a gaming device which offers players the statistical benefits associated with playing a primary game for an elongated period of time or many times, without having to sit through a number of plays of the game.

Other objects, features and advantages of the disclosure will be apparent from the following detailed disclosure, taken in conjunction with the accompanying sheets of drawings, wherein like numerals refer to like parts, elements, components, steps and processes.

BRIEF DESCRIPTION OF THE DRAWINGS

FIG. 4A is a chart illustrating a plurality of background game results.

FIG. 6D is a chart illustrating a plurality of background game results for a play of the primary game.

DETAILED DESCRIPTION

The present disclosure may be implemented in various configurations, including but not limited to: (1) a dedicated gaming machine, gaming system or gaming device, wherein the computerized instructions for controlling any games (which are provided by the gaming machine or gaming device) are provided with the gaming machine or gaming device prior to delivery to a gaming establishment; and (2) a changeable gaming machine, gaming system or gaming device, where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by a central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
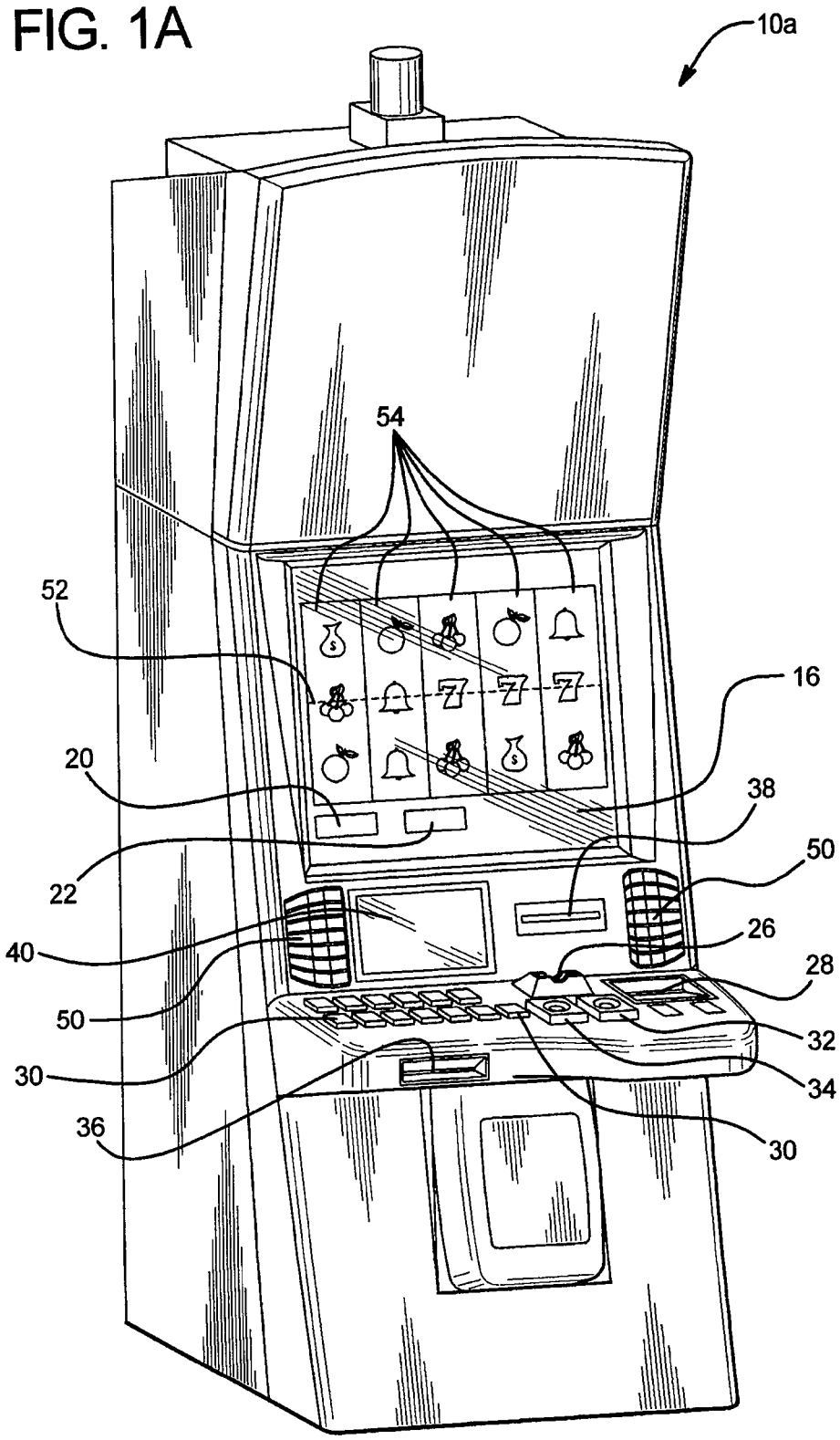
FIGS. 1A and 1B are perspective views of alternative embodiments of the gaming devices of the present disclosure.
Figure 1B:
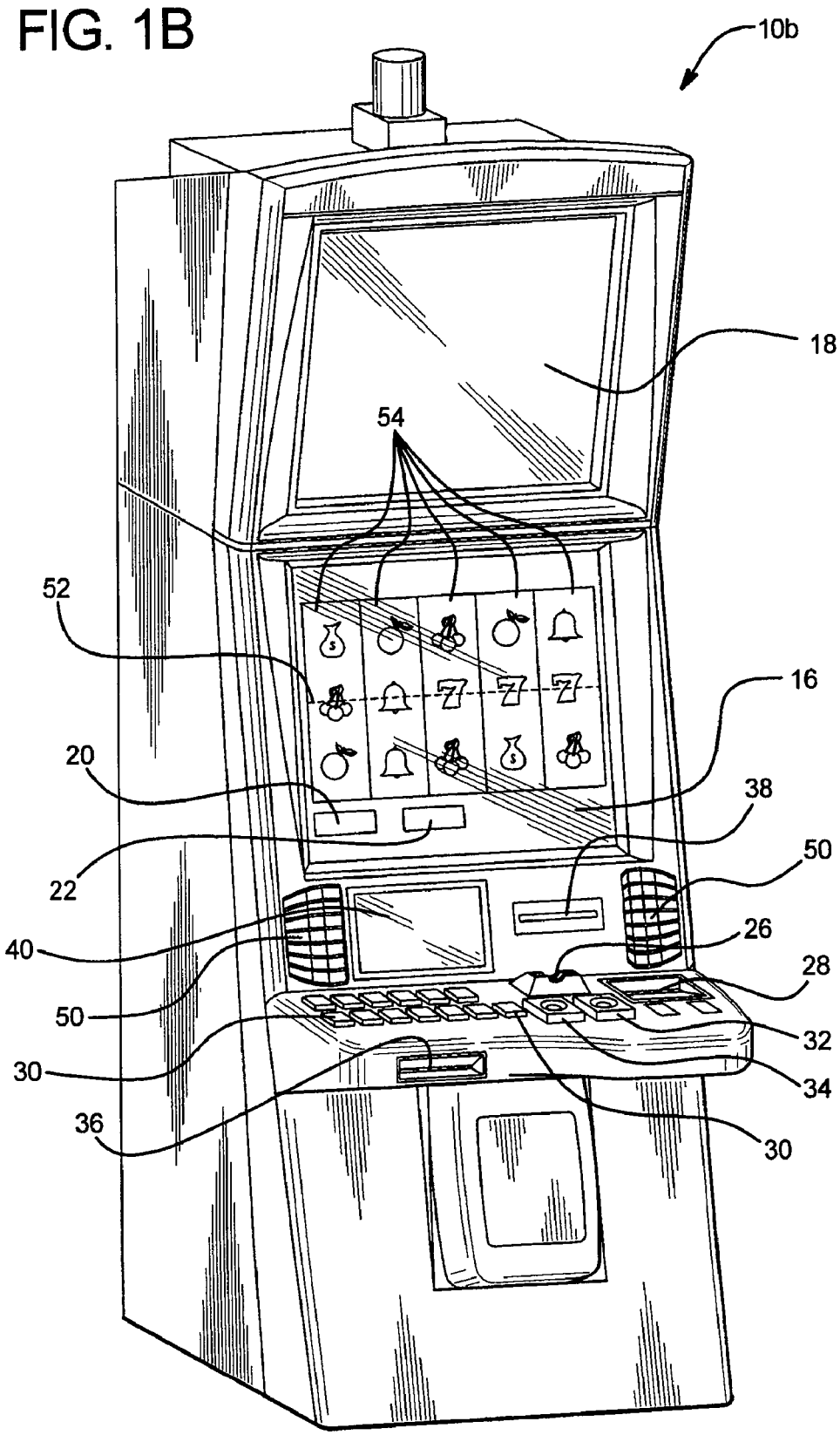

Referring now to the drawings, two example alternative embodiments of the gaming device of the disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
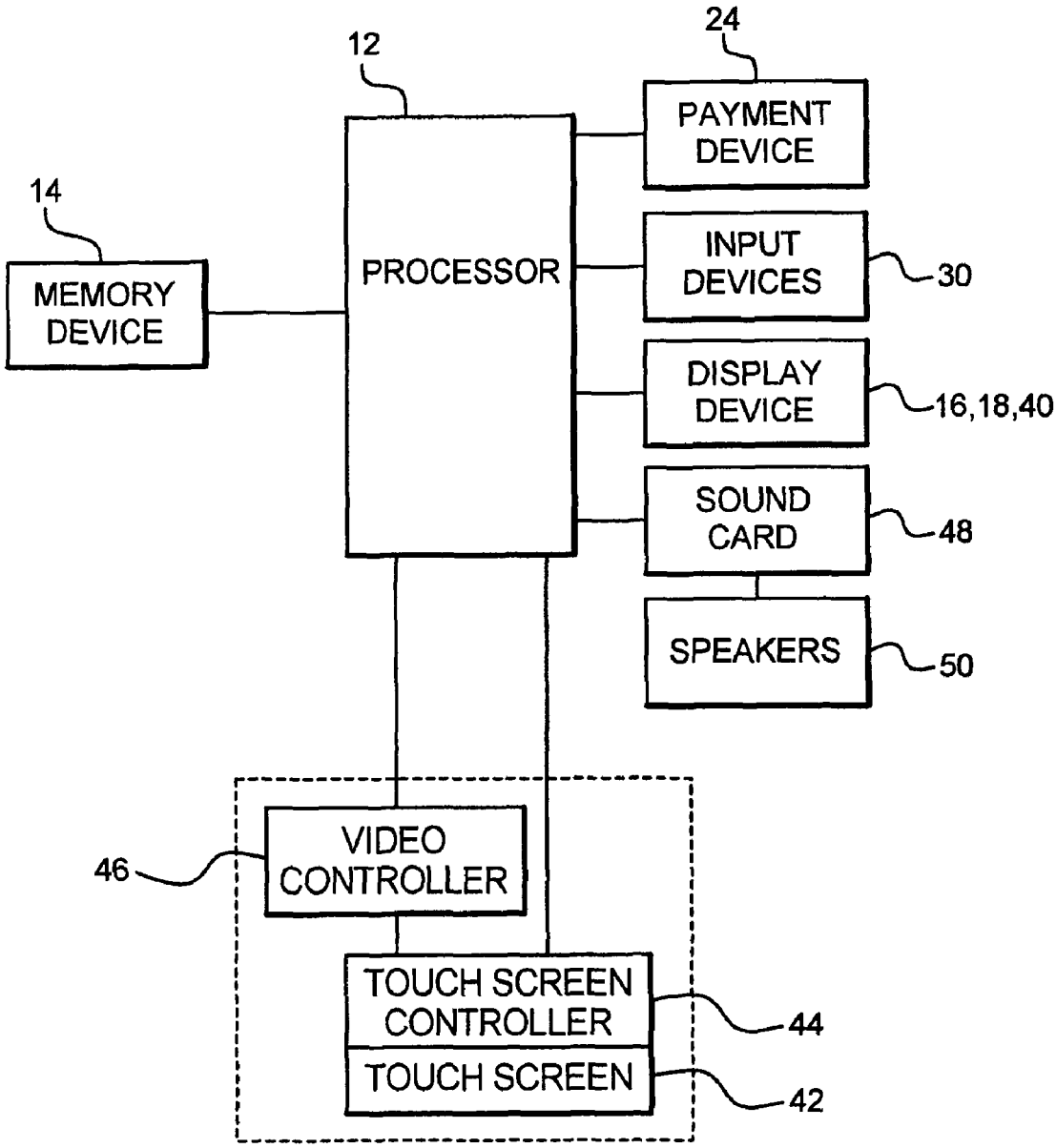
FIG. 2A is a schematic block diagram of the electronic configuration of one embodiment of the gaming devices of the present disclosure.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device or system randomly generates awards, game results and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award, result or other game outcome to be provided to the player based on the associated probabilities. In this embodiment, since the gaming device or system generates outcomes randomly or based upon one or more probability calculations, there is no certainty that the gaming device or system will ever provide the player with any specific award or other game outcome.

In another embodiment, as discussed in more detail below, the gaming device or system employs a predetermined or finite set or pool of awards or other game outcomes. In this embodiment, as each award or other game outcome is provided to the player or is used for a background game, the gaming device or system flags or removes the provided award or other game outcome from the predetermined set or pool. Once flagged or removed from the set or pool, the specific provided award or other game outcome from that specific pool cannot be provided to the player again. This type of gaming device or system provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance or the equivalent. In one embodiment, gaming device includes a bet display 22 which displays a player's amount wagered.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one or a plurality of game or other suitable images, symbols or indicia.

As illustrated in FIG. 2A, in one embodiment, the gaming device includes at least one payment acceptor 24 in communication with the processor. As seen in FIGS. 1A and 1B, the payment acceptor may include a coin slot 26 and a payment, note or bill acceptor 28, where the player inserts money, coins or tokens. The player can place coins in the coin slot or paper money, a ticket or voucher into the payment, note or bill acceptor. In other embodiments, devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a pull arm 32 or a play button 34 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 1A and 1B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips redeemable by a cashier (or other suitable redemption system) or funding to the player's electronically recordable identification card.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places. One such input device is a conventional touch-screen button panel.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming device may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering primary or base game or background game. The gaming machine or device may include some or all of the features of conventional gaming machines or devices. The primary or base game may comprise any suitable reel-type game, card game, cascading or falling symbol game, number game or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a base or primary game or a background game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, display the plurality of simulated video reels 54. Each reel 54 displays a plurality of indicia or symbols, such as bells, hearts, fruits, numbers, letters, bars or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device with wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels, modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more or each of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to being based on how many paylines that would have passed through each of the strings of related symbols in active symbol positions).

In one embodiment, the base, primary or background game may be a poker game wherein the gaming device enables the player to play a conventional game of video draw poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. In another embodiment, the gaming device automatically holds and discards the cards for the player. The gaming device compares the final five-card hand to a payout table which utilizes conventional poker hand rankings to determine the winning hands. The gaming device provides the player with an award based on a winning hand and the credits the player wagered.

In another embodiment, the base, primary or background game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player. In another embodiment, the gaming device automatically holds and discards the player's cards based on an auto-hold table.

In one embodiment, a base, primary or background game may be a keno game wherein the gaming device displays a plurality of selectable indicia or numbers on at least one of the display devices. In one embodiment, the player selects at least one or a plurality of the selectable indicia or numbers via an input device such as the touch screen. In another embodiment, the gaming device selects at least one or a plurality of the selectable indicia or numbers to be the player's numbers. The gaming device then displays a series of drawn numbers to determine an amount of matches, if any, between the player's selected numbers or player's numbers selected by the gaming device and the gaming device's drawn numbers. The player is provided an award based on the amount of matches, if any, based on the amount of determined matches and the number of numbers drawn.

In one embodiment, in addition to winning credits or other awards in a base or primary game via the background game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition may be by exceeding a certain amount of game play (such as number of games, number of credits, amount of time), reaching a specified number of points earned during game play, an event in a background game or a background game result.

In another embodiment, the gaming device processor 12 or central server 56 randomly provides the player one or more plays of one or more secondary games. In one such embodiment, the gaming device does not provide any apparent reasons to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game is accomplished through a simple "buy in" by the player, for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
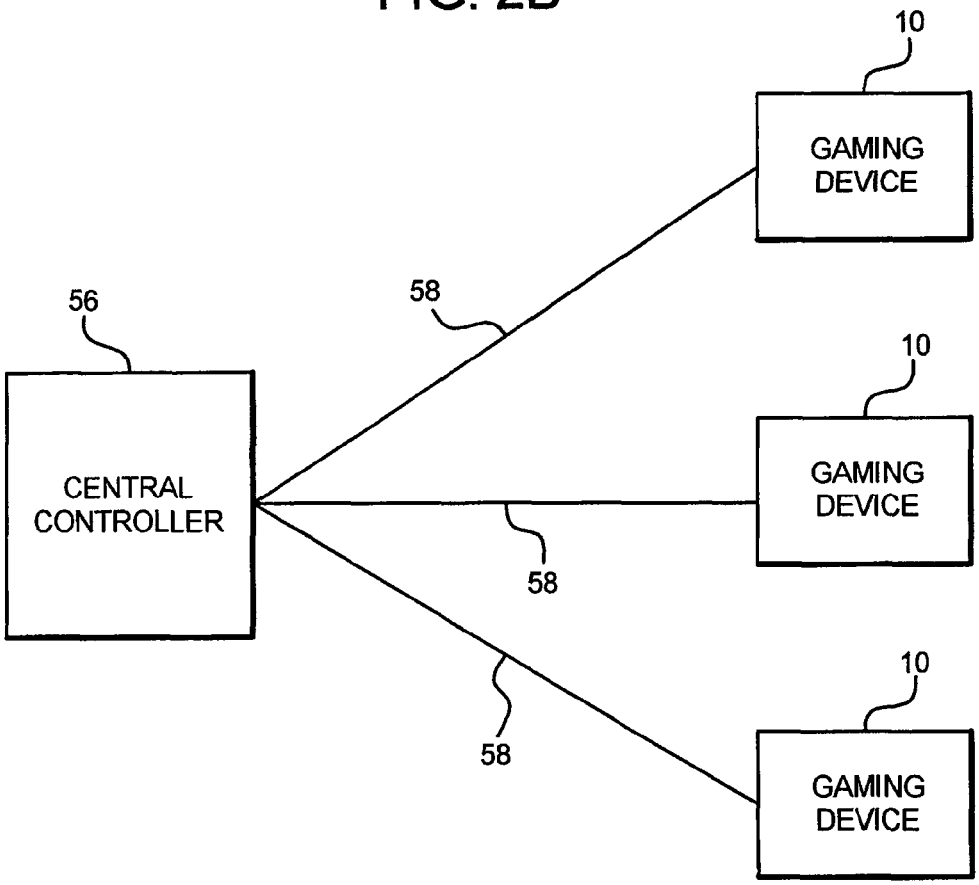
FIG. 2B is a schematic block diagram illustrating a plurality of gaming terminals in communication with a central controller.

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller. In one embodiment, upon a player initiating game play at one of the gaming devices, the initiated gaming device communicates a game outcome request for each background game to the central server or controller.

In one embodiment, the central server or controller receives the game outcome request and randomly generates a game outcome for the primary game or the background game based on probability data. In another embodiment, the central server or controller randomly generates a game outcome for the secondary game based on probability data. In another embodiment, the central server or controller randomly generates a game outcome for both the primary game and/or the background games and/or the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome, such as a background game result, is flagged as used, it is prevented from further selection from the set or pool and cannot be selected by the central controller or server upon another wager. The provided game outcome can include a primary game outcome, a secondary game outcome, primary and secondary game outcomes, one or more background game results, or a series of game outcomes such as free games. In one embodiment, the gaming device enables the player to select the pool that the outcomes are chosen from. For example, certain pools have higher payback percentages and the player may wager more to obtain some or all of the background game results from the pool with the higher payback percentage.

The central server or controller communicates the generated or selected game outcome(s) to the initiated gaming device. The gaming device receives the generated or selected game outcome(s) and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo, keno or lottery game. In this embodiment, each individual gaming device utilizes one or more bingo, keno or lottery games to determine a predetermined game outcome value for each background game that is provided to the player for the interactive primary game played at that gaming device. In one embodiment, the bingo, keno or lottery game is displayed to the player. In another embodiment, the bingo, keno or lottery game is not displayed to the player, but the results of the bingo, keno or lottery game determine the predetermined game outcome value for the primary or secondary game. In another embodiment, the bingo, keno or lottery game is not displayed to the player, but the results of the bingo, keno or lottery game determine the background game predetermined results which are provided to the player for the primary or secondary game.

In the various bingo embodiments, as each gaming device is enrolled in the bingo game, such as upon an appropriate wager or engaging an input device, the enrolled gaming device is provided or associated with a different bingo card or a different bingo card for each background game. Each bingo card consists of a matrix or array of elements, wherein each element is designated with a separate indicia, such as a number. It should be appreciated that each different bingo card includes a different combination of elements. For example, if four bingo cards are provided to four enrolled gaming devices or a same gaming device for four background games, the same element may be present on all four of the bingo cards while another element may solely be present on one of the bingo cards.

In operation of these embodiments, upon providing or associating a different bingo card to each of a plurality of enrolled gaming devices or for each background game of each gaming device, the central controller randomly selects or draws, one at a time, a plurality of the elements. As each element is selected, a determination is made for each bingo card as to whether the selected element is present on that provided bingo card. This determination can be made by the central controller, the gaming device, a combination of the two, or in any other suitable manner. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices or for each background game based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. In one embodiment, the gaming system provides a bingo card for each background game and the results of each background game are determined by the bingo method described above. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. In this embodiment, the gaming device and/or player tracking system tracks any players gaming activity at the gaming device. In one such embodiment, the gaming device and/or associated player tracking system timely tracks when a player inserts their playing tracking card to begin a gaming session and also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different paytables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Figure 3:
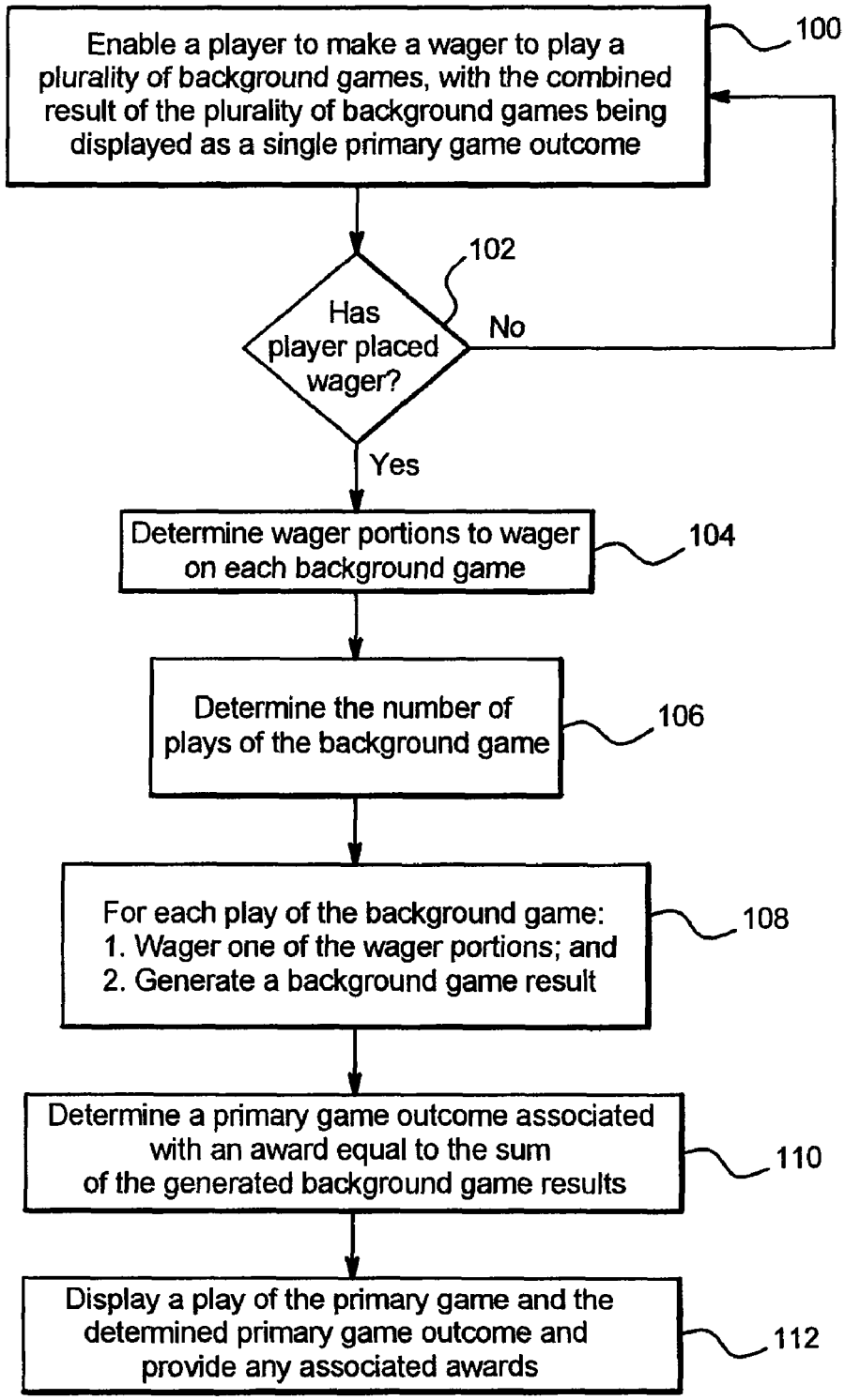
FIG. 3 is a flow chart of the method of one embodiment of the present disclosure.

Primary Game Award and/or Outcome Based on a Plurality of Background Game Results Referring now to FIG. 3, in one embodiment, a gaming device enables a player to fund the gaming device as illustrated in block 100. The gaming device enables the player to make a wager or place a wager to play a plurality of background games. The gaming device displays the combined background game results as a single primary game outcome and/or award. The gaming device determines if the player placed the wager as illustrated in diamond 102. If the player does not place the wager, the gaming device further enables a player to place the wager as illustrated in block 100. If the player places the wager, the gaming device determines the wager portions to wager on each background game as illustrated in block 104. That is, the gaming device determines the amount of each of the portions to be wagered. In one embodiment, the wager portions are equal amounts. In another embodiment, one or more of the wager portions are one or more different amounts. In one embodiment, the gaming device determines the number of plays of the background game as illustrated in block 106. As illustrated in block 108, for each play of the background game, the gaming device wagers one of the wager portions and generates a background game result. In one embodiment, the gaming device does not display the plays of the background game or the individual background game results to the player. The gaming device determines a primary game outcome that is associated with an award equal to a sum of the background game results as illustrated in block 110. The gaming device displays a play of the primary game and the determined primary game outcome as illustrated in block 112. The gaming device provides any associated awards to the player as illustrated in block 112.

Figure 4B:
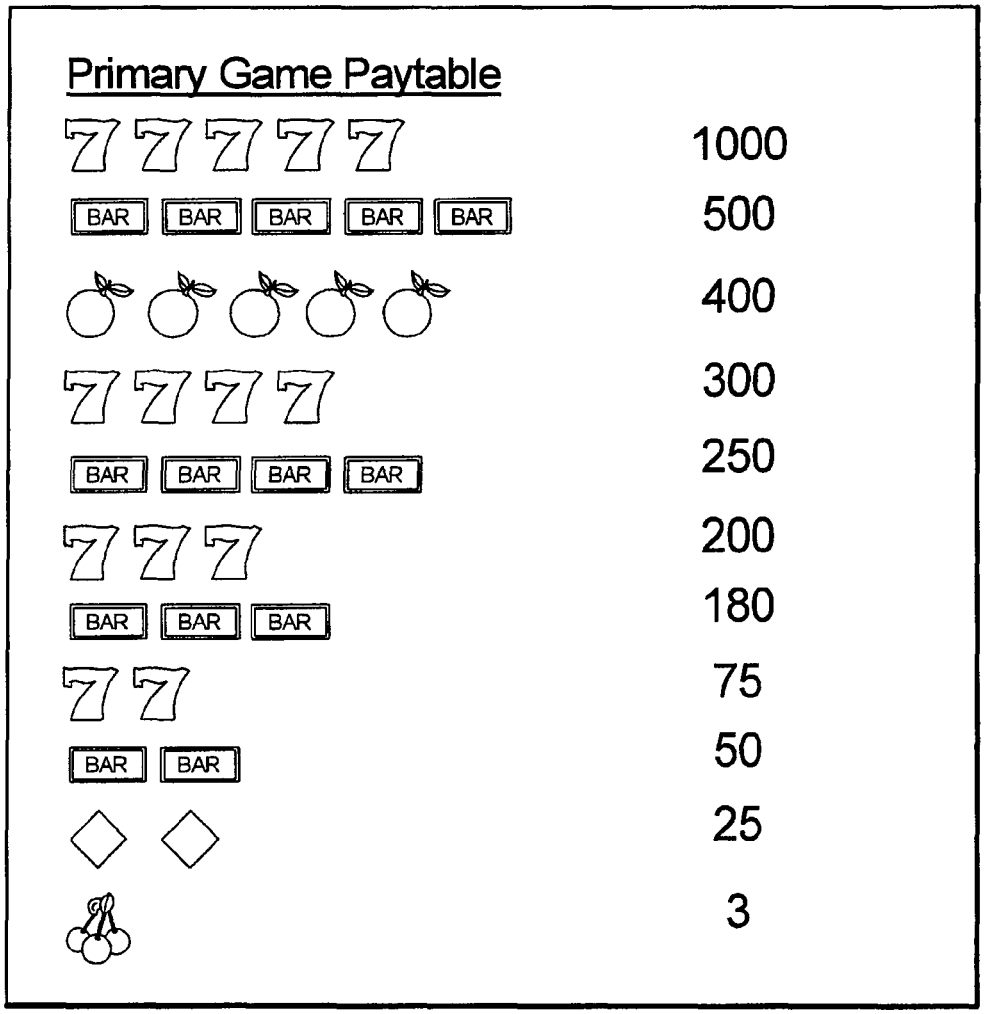
FIG. 4B is one embodiment of a paytable of the primary game.

FIGS. 4A, 4B, 4C, 4D and 4E illustrate one play of the primary game. In the illustrated embodiment, the gaming device plays twenty-five plays of the background game and provides the combined results of the twenty-five background games to the player in a play of a single primary game. As illustrated in FIG. 4A, after the player places a wager of $50 or 200 credits (not illustrated) on a quarter credit gaming device, the gaming device completes twenty-five plays of the background game and generates twenty-five background game results, each determined with a $2 wager portion. For example, as illustrated in FIG. 4A, in the first play of the background game, the background game result is zero credits. In the second play of the background game, the background game result is zero credits. In the third play of the background game, the background game result is zero credits. In the fourth play of the background game, the background game result is forty credits. In one embodiment, the gaming device combines the background game results to determine the primary game outcome and the primary game award. In one such embodiment, the gaming device sums or totals the background game results and this sum is the primary game award provided to the player. In one embodiment, the gaming device does not display any of the individual background game results.

As illustrated in FIG. 4B, the primary game is associated with a paytable that includes a plurality of game outcomes and a plurality of awards. In one embodiment, the awards of the paytable alone or in combination equal the possible sums of the background game results. For example, if the only possible background game results are 0, 5 or 10, the paytable would include awards of 0, 5 and 10 and suitable other awards that combine in a single primary game outcome to form the awards of 5 and 10, such as 2 and 3 and 8 and 2, etc.

Figure 4C:
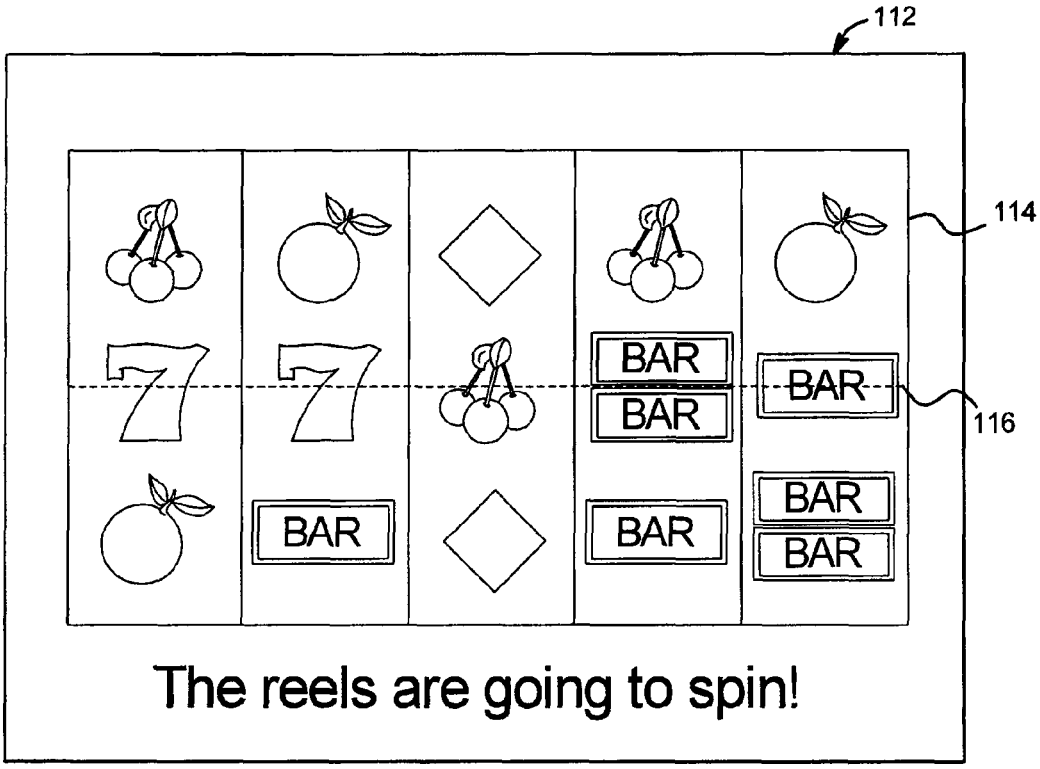
FIGS. 4C, 4D, and 4E are screen shots of the primary game corresponding to the background game results of FIG. 4A.

As illustrated in FIG. 4C, the gaming device displays the primary game 114, which in the illustrated embodiment is a slot game 114 with one active payline 116. In one embodiment, the gaming device selects the primary game outcome based on the paytable such that the award associated with the primary game outcome has a value that is based on the combined background game results. In one embodiment, if a single winning primary game outcome does not equal the background game results, the gaming device appropriately provides the player the remaining background game results. For example, the gaming device provides the primary game outcome with an award closest to the background game results and then provides the player one or more free spins or bonus games until the total of the background game results are provided to the player.

Figure 4D:
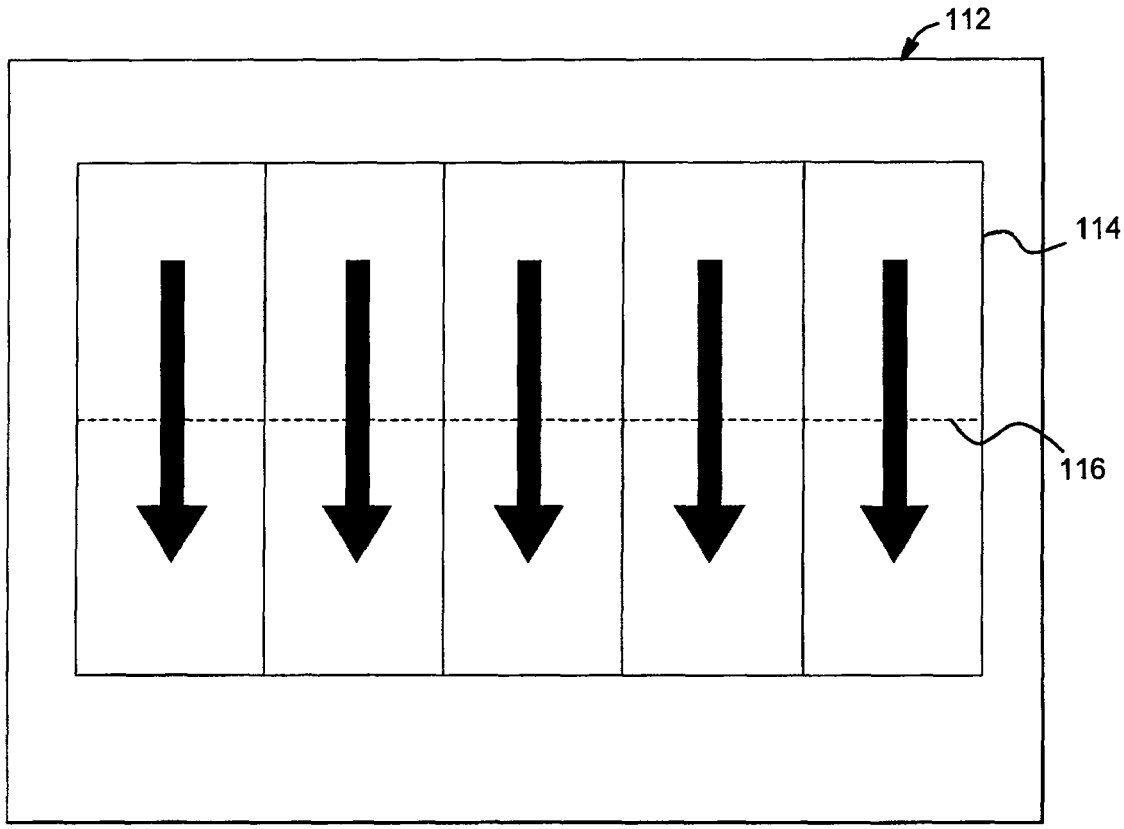
Figure 4E:
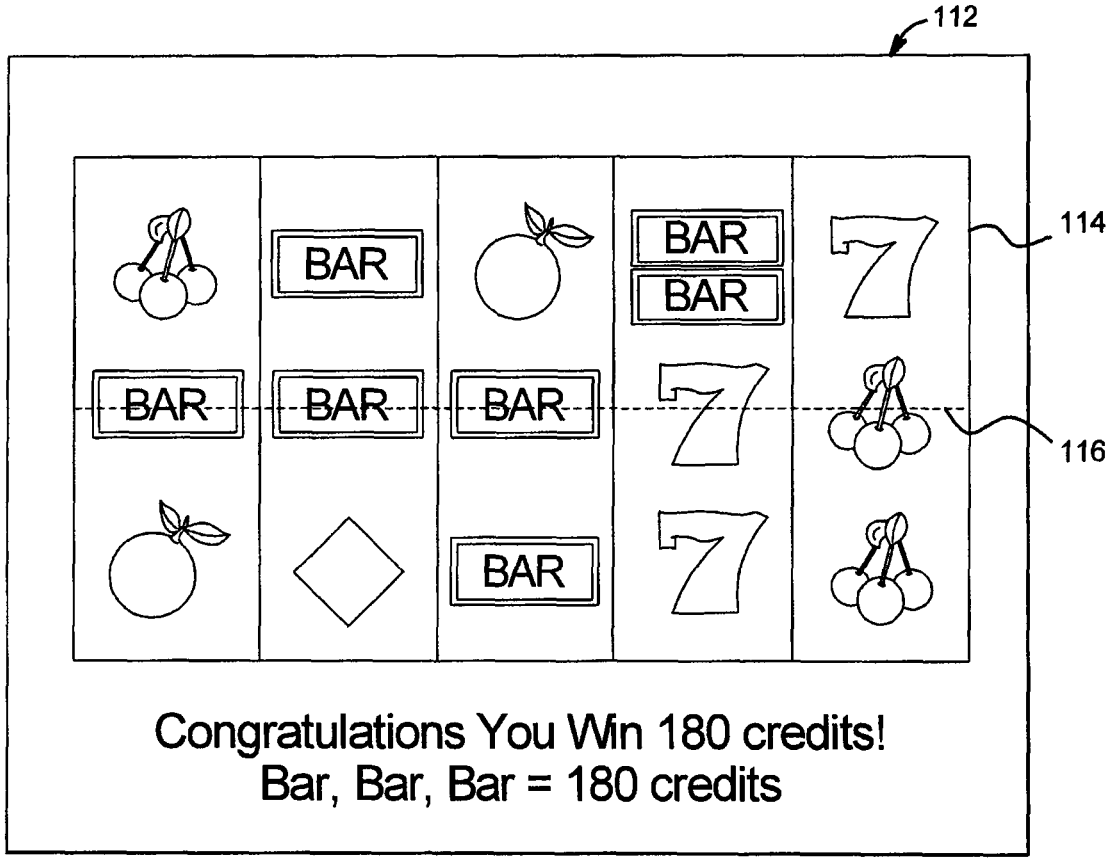

In the illustrated embodiment, the gaming device spins the reels as illustrated in FIG. 4D. As illustrated in FIG. 4E, the gaming device generates a symbol combination of bar-bar-bar which is associated with an award of one hundred and eighty credits as illustrated in FIG. 4B. Therefore, the gaming device provides the player a primary game award of 180 credits, the sum of the background game results.

It should be appreciated that wagering portions of the wager over a plurality of background games diversifies the player's risk. Wagering a smaller amount over a plurality of games decreases the volatility. For example, as illustrated in FIG. 4A, the background game results ranged from 0 credits to 40 credits over the 25 games. If the player wagered $50 on the first game, the player would have lost it all. However, if the player had wagered $50 on the fourth game, the player would have won $1000. The volatility of a single game would have been 0 credits to 1000 credits with a $50 wager. However, the likelihood of receiving an award or generating a winning symbol combination in a single play of a game is less than the likelihood of receiving an award or generating a winning symbol combination over multiple plays of a game. The player is more likely to win an award by playing a plurality of games.

In another embodiment, the gaming device displays the amount of the award provided to the player via numerals in the primary game. For example, if the primary game is a three reel slot game and the background game results equal 375 credits, the gaming device displays a 3 on the first reel, a 7 on the second reel and a 5 on the third reel for the primary game outcome and provides the player a primary game award of 375 credits.

Figure 5:
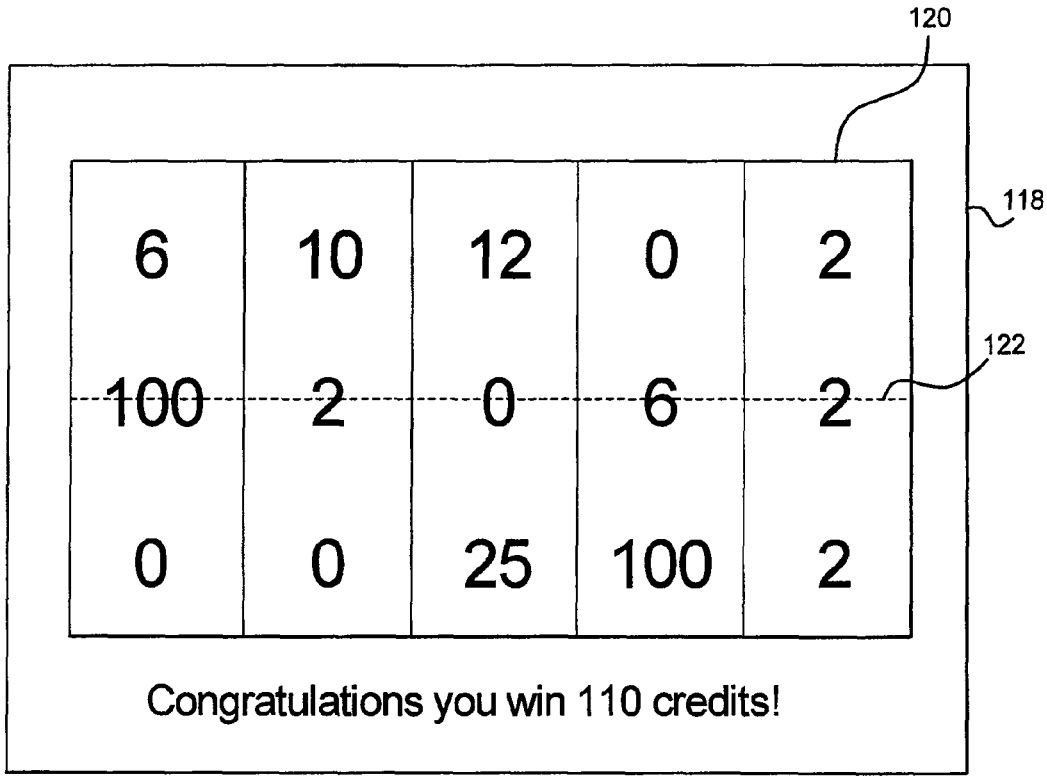
FIG. 5 is a screen shot of an alternative embodiment of a primary game.

FIG. 5 illustrates another embodiment of the gaming device providing a primary game outcome to a player based on a plurality of background game results. In this embodiment, the gaming device generates a numerical primary game outcome with a sum equal to the combined background game results. In the illustrated example, a display device 118 of the gaming device displays a plurality of numerical values as the primary game 120. In the illustrated embodiment, the gaming device generates an award on the payline 122 with a sum equal to an amount of the background game results. In this embodiment, the gaming device generates the following values on the payline: 100, 2, 0, 6 and 2. In this embodiment, the gaming device previously randomly generated background game results equaling an award of 110 credits. Therefore, the gaming device generated numbers on the payline with a sum of 110 credits.

In another such embodiment, the gaming device displays actual win amounts of the background game results in the primary game. For example, the primary game is a slot game. The background game results are 0, 4, 24, 0, 0, 0, 9, 15, 120, 0, 0, 0, 0, 0, and 150. The gaming device generates the numbers 0, 4, 24, 0, 0, 0, 9, 15, 120, 0, 0, 0, 0, 0, and 150 on active paylines of a gaming device or in another suitable form.

Figure 6A:
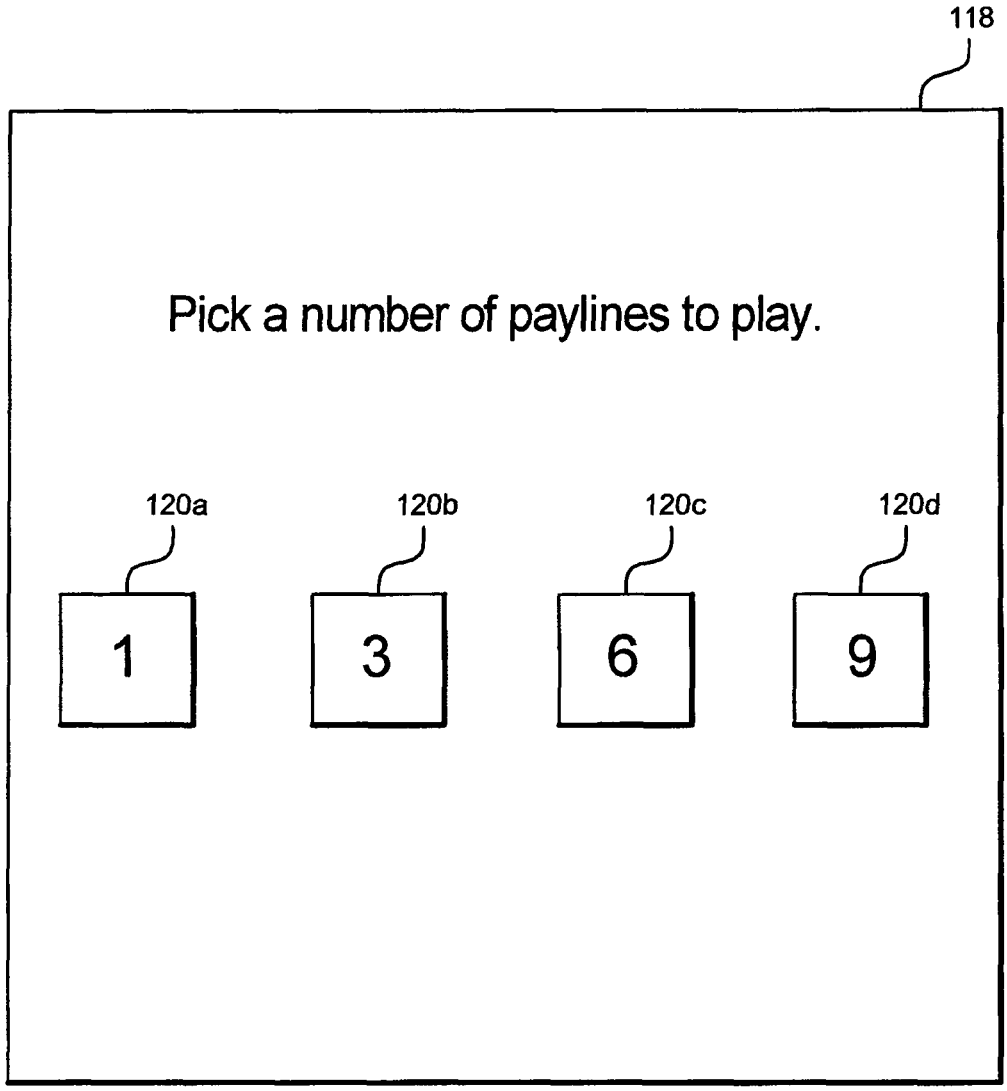
FIGS. 6A, 6B, 6C and 6E are screen shots of the primary game corresponding to the background game results of FIG. 6D.

As illustrated in FIGS. 6A, 6B, 6C, 6D and 6E, in one embodiment, the gaming device generates a plurality of background game results and displays them to the player as more than one determination in the primary game. As illustrated in FIG. 6A, the gaming system enables the player to determine how many paylines to play using the touch screen buttons 120*a* to 120*d*.

Figure 6B:
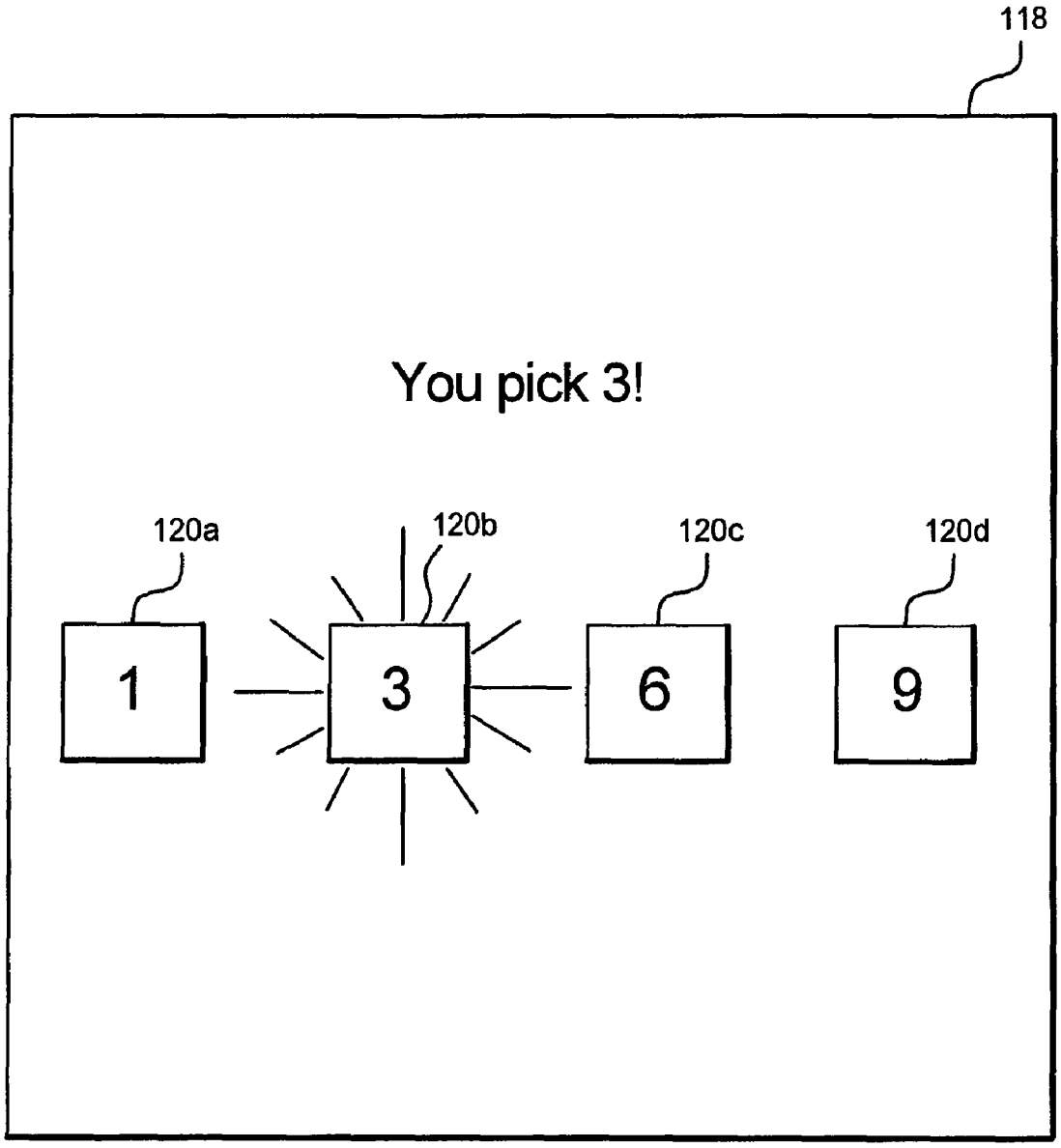
Figure 6C:
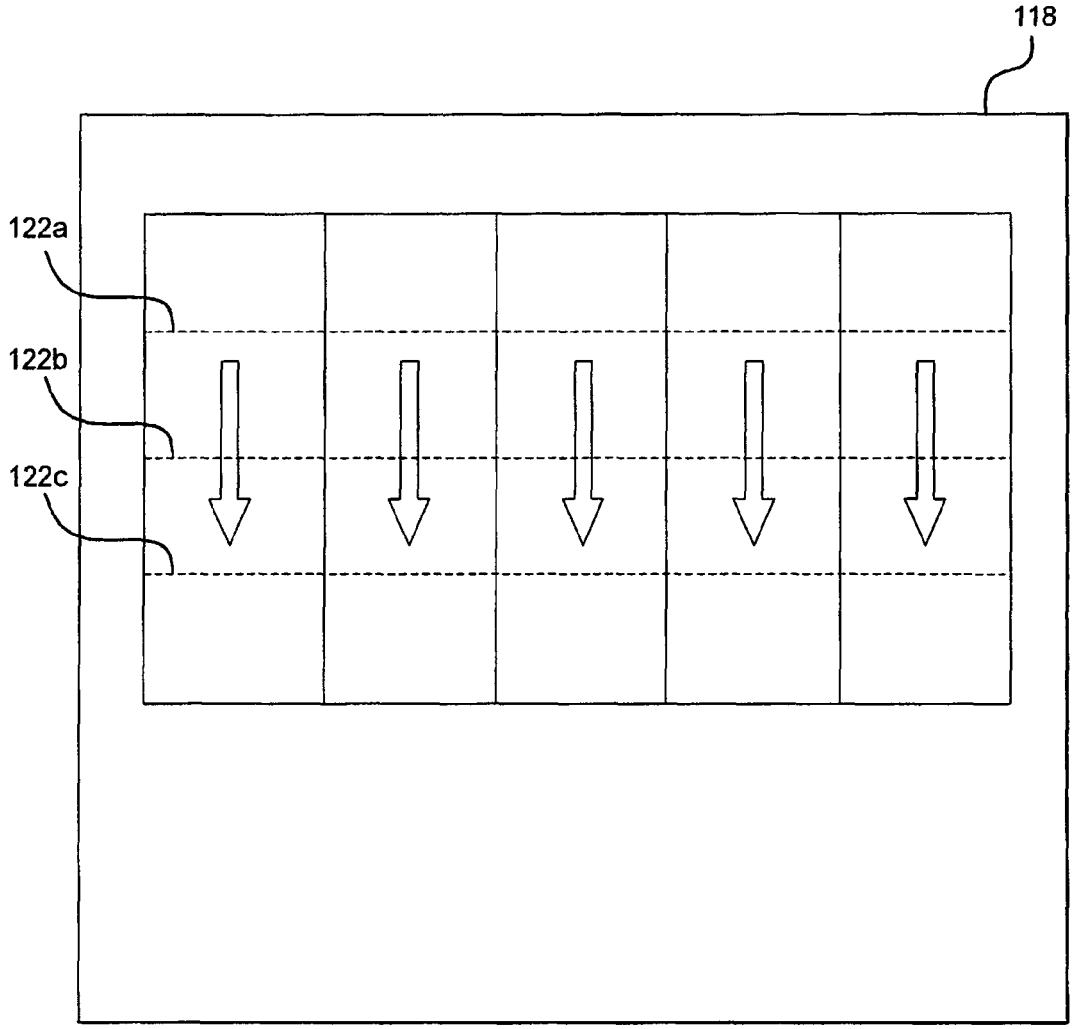
Figure 6E:
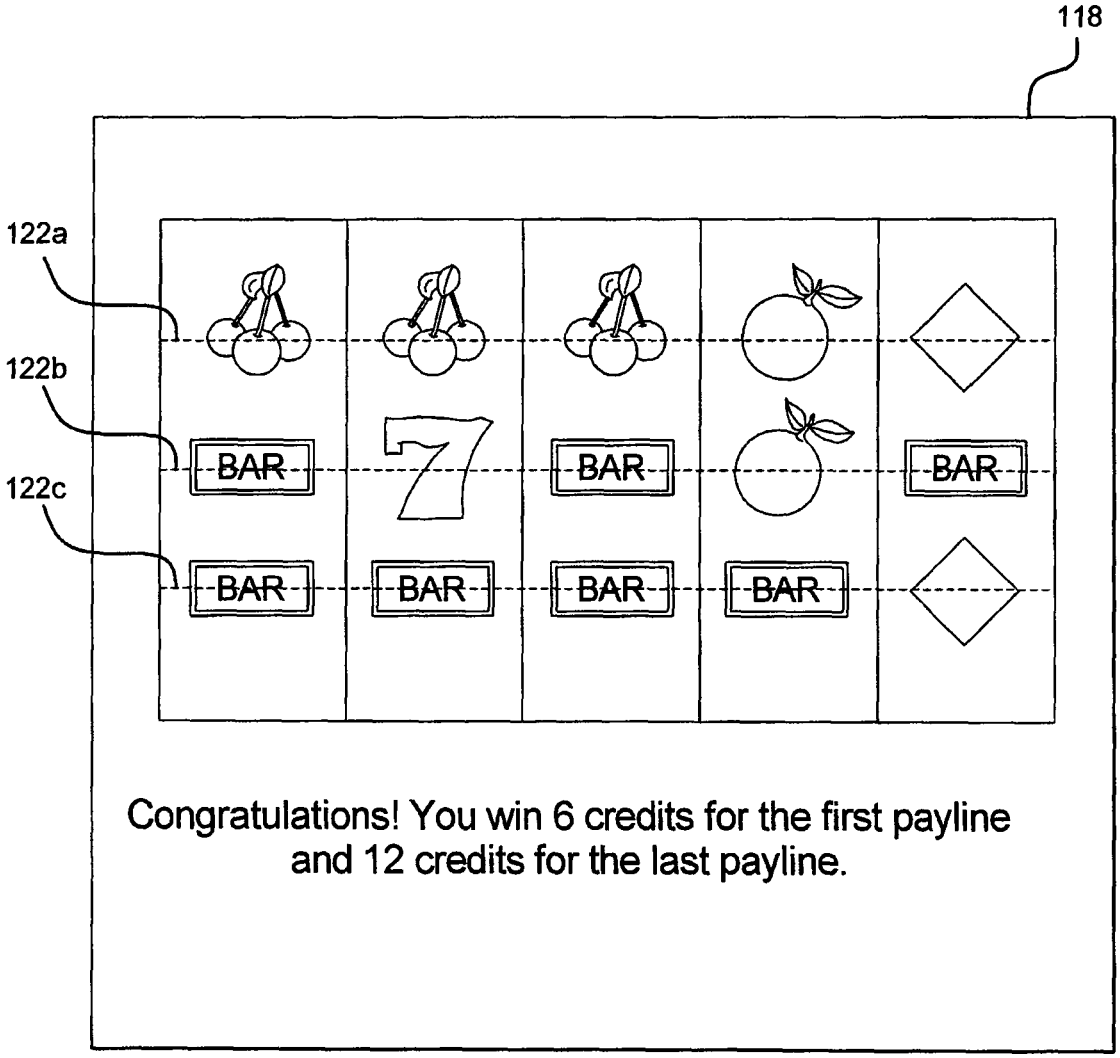

As illustrated in FIG. 6B, the player makes an input to play three paylines. As illustrated in FIG. 6C, the gaming system displays the reels spinning. As illustrated in FIG. 6D, the gaming device determines a plurality of background game results. The sum of these background game results is eighteen credits. As illustrated in FIG. 6E, the gaming device generates a plurality of symbols on the three paylines. As illustrated in FIG. 6E, the gaming system determines that the player wins six credits on the first payline 122*a* and twelve credits on the last payline 122*c*. It should be appreciated that the credits may be divided between the paylines of the game in any suitable manner.

In another embodiment, each payline of a slot game represents a background game result. For example, if the player selects to play five background games, the player plays five paylines in the slot primary game. Each of the background game results are then represented on each of the paylines. In one such embodiment, each background game result is individually represented on one of the paylines. For example, if the background game results are 0, 2, 2, 0 and 5, a first payline has a result of 0. A second payline has a result of 2. A third payline has a result of 2. A fourth payline has a result of 0. A fifth payline has a result of 5. In another embodiment, the background game results are represented on the paylines of the slot game, such that they do not directly match the payline results For example, if the background game results are 0, 2, 2, 0 and 5, a first payline has a result of 0. A second payline has a result of 0. A third payline has a result of 4. A fourth payline has a result of 4. A fifth payline has a result of 1. Therefore, the primary game outcomes and awards are based on the background game results but do not individually represent each of the background game results. These methods may be used for any suitable type of game including but not limited to multi-hand poker games.

It should be appreciated that the primary game may be any suitable game, including but not limited to auction, slot, bingo, poker, keno, blackjack, craps, bunco, checkers and any combination thereof. It should be appreciated that the gaming device may display or indicate the combined background game results to the player in any suitable manner via the primary game.

It should be appreciated that the background game may be any suitable game including but not limited to auction, slot, bingo, poker, multi-hand poker, keno, blackjack, craps, bunco, checkers and any combination thereof. It should be appreciated that the background game outcomes and background game results may be determined in any suitable manner. For example, the background game outcomes and background game results may be determined based on any of the methods described herein with regard to the primary and bonus games. In one embodiment, the background game outcomes and background game results are determined via a paytable. In another embodiment, the background game outcomes and background game results are determined by a central pool. In one such embodiment, the available wager amounts for the primary game are multiples of the cost of the seed. The gaming system then requests the number of background game results that are divisible by the wager amount. In one embodiment, the background game results are not game outcomes, such as symbol combinations, but are randomly generated numbers that are associated with numbers of credits or other suitable awards.

In another embodiment, the gaming device continually and randomly generates random numbers or seeds for the background game. Each of the seeds is associated with a symbol or other game element. When the player initiates play of the primary game, the gaming device selects, calculates or generates the next required amount of seeds to determine outcomes of the background game. For example, if the background game is a five reel slot game with one hundred plays of the background game, for each play of the background game, the gaming device selects the next five generated seeds and determines which symbol associated with each seed. The gaming device then evaluates each symbol combination to determine the associated background game result. The gaming device repeats this process for each play of the background game. The gaming device accumulates each of the background game results and provides a primary game award equal to the sum of the background game results.

In one embodiment, the primary game and the background game are the same game. In another embodiment, the primary game and the background game are different types of games. In one embodiment, the gaming device enables the player to select the primary game. In one embodiment, the gaming device enables the player to select the background game. In another embodiment, the gaming device enables the player to select both the primary game and the background game. In one embodiment, each of the background games for a primary game are the same type of game. For example, the background games for a single play of a primary game are all slot games. In another embodiment, a plurality of the background games for a single play of a primary game are different types of games. For example, a slot game and a poker game are both background games for a single play of a primary game. It should be appreciated that the background game results for a primary game may be determined in any suitable manner. It should also be appreciated that the background games and the primary games may be determined by the same methods or different methods of game determination.

It should also be appreciated that part or all of the random determination of the background game outcomes and background game results can be displayed in any suitable manner. In one embodiment, the individual background game outcomes and/or individual game results are not displayed at all.

In an alternative embodiment, the gaming device displays one or more of the background game results. In one embodiment, the gaming device displays the highest background game result or award. In another embodiment, the gaming device displays a certain number of the highest background game results. In another embodiment, the gaming device displays each of the winning background game results. In another embodiment, the gaming device displays each of the background game results. In another embodiment, the gaming device displays a list of some or each of the background game results.

It should be appreciated that the gaming device may determine one or more primary game awards based on the background game results in any suitable manner. In one embodiment, the gaming device sums the background game results and provides this sum as a single primary game award to the player. In another embodiment, the gaming device provides the player more than one primary game outcome and award such that the player is provided all of the background game results. For example, if a total of the background game results are 150 credits and the available primary game awards are only 50 credits, 100 credits, 200 credits and 300 credits, the gaming device provides the player two primary game outcomes and awards: one primary game outcome associated with the award of 50 credits and another primary game outcome associated with an award of 100 credits. The gaming device may provide the player any suitable number of primary game outcomes and awards.

In another embodiment, the gaming device bases the primary game award on the background game results but the primary game award is not the sum of the background game results. For example, the gaming device provides the player with 90% of the sum of the background game results as a primary game award.

It should be appreciated that the wager portions or components may be determined in any suitable manner. In one embodiment, the wager portions are predetermined and the player funds the gaming device with a certain designated amount of credits or a designated monetary amount to play the primary game. For example, the player must wager $75 to play a primary game. In another embodiment, the gaming device enables the player to determine the wager portion. In one embodiment, the gaming device enables the player to select the credit denomination of the wager portion. For example, the gaming device enables the player to select among $0.10, $0.25, $0.75 and $1 as the credit denominations. In one such embodiment, the same amount of credits are wagered for every play of the background game. Therefore, the gaming device enables the player to customize the amount wagered. In another embodiment, the credit denominations are predetermined, and the gaming device enables the player to select the number of credits to wager per play of the background game. For example, the gaming device enables the player to select to wager 1, 3 or 5 credits for the wager portions for each background game. It should be appreciated that the wagering credits may be any suitable value. In one embodiment, the wager portions are small but the number of plays of background games is high such that the gaming device enables the player to wager a lot of credits quickly with diversified risk.

In one embodiment, the wager portions are different amounts. For example, the player or the gaming device may determine that the wager portions for the first five background games are a first amount and the wager portions for the second five background games are a second amount. The background game results then reflect the different wager portion amounts.

It should be appreciated that the number of plays of the background game may be determined in any suitable manner. In one embodiment, the gaming device determines the number of plays of the background game. In another embodiment, the gaming device enables a player to determine the number of plays of the background game but requires a certain wager amount. In this embodiment, the player determines the wager portions by selecting a number of background games.

In certain embodiments, one or more of the background games may trigger a bonus game. In one such embodiment, any bonus game award is included in the primary game outcome win. In another such embodiment, any bonus game triggered by the background game is displayed to the player. That is, the gaming device enables a player to play any bonus games triggered by a background game. In another embodiment, if a bonus game is triggered by a background game, the gaming device provides the player a separate bonus award.

The background game results may be any suitable award. In one embodiment, the background game results are credits. In another embodiment, the background game results are plane tickets or a free hotel room. In another embodiment, the background game results are free games, multipliers, bonus games or any combination thereof. It should be appreciated that the background game results may include any suitable number of different kinds of results.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

at least one processor;

at least one display device configured to display a primary game having a paytable that includes a plurality of awards;

at least one input device; and at least one memory device which stores a plurality of instructions, which when executed by the at least one processor, cause the at least one processor to operate with the at least one display device and the at least one input device to:

(a) enable a single wager to be made by a player on a play of the primary game;

(b) automatically allocate a plurality of portions of said single wager to a plurality of plays of a background game and cause the plurality of plays of the background game without displaying the plays of the background game and without indicating to the player the plays of the background game;

(c) for each said play of said background game, independently randomly determine a background game result from a plurality of different background game results, wherein each of the plurality of the background game results can be randomly determined for any number of the plays of the background game;

(d) determine a primary game outcome for the play of the primary game that is associated with an award equal to a sum of the background game results based on the paytable;

(e) display the determined primary game outcome; and (f) display said award.

2. The gaming system of claim 1, which includes at least two different types of background games.

3. The gaming system of claim 1, wherein at least two of the portions of the wager are different amounts.

4. The gaming system of claim 1, wherein when said plurality of instructions are executed by the at least one processor, the at least one processor determines a number of said plays of said background game.

5. The gaming system of claim 1, wherein the at least one processor resides remote from a housing which supports said at least one display device and said at least one input device.

6. A gaming system comprising:

at least one processor;

at least one display device configured to display a primary game;

at least one input device; and at least one memory device which stores a plurality of instructions, which when executed by the at least one processor, cause the at least one processor to operate with the at least one display device and the at least one input device to:

(a) enable a single wager to be made by a player on a play of the primary game;

(b) automatically allocate a plurality of portions of said single wager to a plurality of plays of a background game and cause the plurality of plays of the background game without displaying the plays of the background game and without indicating to the player the plays of the background game;

(c) determine a combined background game result from a plurality of different background game results based on background game results of each said play of said background game, wherein each of the background game results is determined independently from the other background game results of the plays of the background game and each of the plurality of the background game results can be randomly determined for any number of the plays of the background game;

(d) display the play of the primary game;

(e) display an outcome for said play of the primary game which is associated with an award equal to the combined background game result; and (f) display said award.

7. The gaming system of claim 6, which includes at least two different types of background games.

8. The gaming system of claim 6, wherein at least two of the portions of the wager are different amounts.

9. The gaming system of claim 6, wherein at least two of the portions of the wager are different amounts.

10. The gaming device of claim 6, wherein when said plurality of instructions are executed by the at least one processor, the at least one processor determines a number of said plays of said background game.

11. The gaming device of claim 6, wherein said combined background game result is a sum of each background game result.

12. The gaming system of claim 6, wherein the at least one processor resides remote from a housing which supports the at least one display device and the at least one input device.

13. A method of operating a gaming system, said method comprising:

(a) enabling a single wager to be made by a player on a play of a primary game having a paytable including a plurality of awards;

(b) automatically allocating a plurality of portions of said single wager to a plurality of plays of a background game and causing the plurality of plays of the background game without displaying the plays of the background game and without indicating to the player the plays of the background game;

(c) for each said play of said background game, independently randomly determining a background game result from a plurality of different background game results, wherein each of the plurality of the background game results can be randomly determined for any number of the plays of the background game;

(d) determining a primary game outcome for the play of the primary game that is associated with an award equal to a sum of the background game results based on the paytable;

(e) displaying the determined primary game outcome; and (f) displaying the award.

14. The method of claim 13, which includes providing at least two different types of background games.

15. The method of claim 13, which includes causing at least two of the portions of the wager to be different amounts.

16. The method claim 13, which is provided through a data network.

17. The method of claim 16, wherein the data network is an internet.

18. A method of operating a gaming system, said method comprising:

(a) enabling a wager to be made by a player on a play of the primary game;

(b) automatically allocating a plurality of portions of said single wager to a plurality of plays of a background game and causing the plurality of plays of the background game without displaying the plays of the background game and without indicating to the player the plays of the background game;

(c) determining a background game result for each of said plays of the background game, wherein each background game result is determined independently from the other background game results and each of a plurality of the background game results can be randomly determined for any number of the plays of the background game;

(d) determining a combined background game result based on the background game results of each said play of said background game;

(e) displaying the play of the primary game;

(f) displaying an outcome for said play of the primary game which is associated with an award equal to the combined background game result; and (g) displaying said award.

19. The method of claim 18, which includes providing at least two different types of background games.

20. The method of claim 18, which includes causing at least two of the portions of the wager to be different amounts.

21. The method of claim 18, which includes determining the portions of the wager based on an amount of the wager.

22. The method of claim 18, wherein said combined background game result is a sum of each background game result.

23. The method claim 18, which is provided through a data network.

24. The method of claim 23, wherein the data network is an internet.

* * * * *

UNITED STATES PATENT AND TRADEMARK OFFICE

CERTIFICATE OF CORRECTION

PATENT NO. : 8,152,624 B2
APPLICATION NO. : 11/853952
DATED : April 10, 2012
INVENTOR(S) : Peter Gerrard et al.

It is certified that error appears in the above-identified patent and that said Letters Patent is hereby corrected as shown below:

IN THE CLAIMS

In Claim 3, Column 27, Line 39, between “the” and “wager” insert --single--.
In Claim 8, Column 28, Line 14, between “the” and “wager” insert --single--.
In Claim 9, Column 28, Line 16, between “the” and “wager” insert --single--.
In Claim 15, Column 28, Line 53, between “the” and “wager” insert --single--.
In Claim 18, Column 28, Line 60, between “a” and “wager” insert --single-- and replace “the” with --a--.
In Claim 21, Column 30, Line 6, between “the” and “wager” insert --single--.

Signed and Sealed this
Twenty-eighth Day of August, 2012

David J. Kappos

David J. Kappos
*Director of the United States Patent and Trademark Office*